US010192530B2

(12) United States Patent
Glaser, II et al.

(10) Patent No.: US 10,192,530 B2
(45) Date of Patent: Jan. 29, 2019

(54) MUSICAL INSTRUMENT PITCH CHANGER

(71) Applicants: Joseph Glaser, II, Franklin, TN (US); John Russell Alford, Nashville, TN (US)

(72) Inventors: Joseph Glaser, II, Franklin, TN (US); John Russell Alford, Nashville, TN (US)

( * ) Notice: Subject to any disclaimer, the term of this patent is extended or adjusted under 35 U.S.C. 154(b) by 0 days.

(21) Appl. No.: 15/645,962

(22) Filed: Jul. 10, 2017

(65) Prior Publication Data

US 2018/0033413 A1 Feb. 1, 2018

Related U.S. Application Data

(63) Continuation of application No. 15/232,461, filed on Aug. 9, 2016, now Pat. No. 9,704,458, which is a continuation of application No. 14/109,168, filed on Dec. 17, 2013, now Pat. No. 9,412,346.

(60) Provisional application No. 61/751,375, filed on Jan. 11, 2013.

(51) Int. Cl.

| | |
|---|---|
| ***G10D 3/14*** | (2006.01) |
| ***G10D 3/00*** | (2006.01) |
| ***G10D 3/04*** | (2006.01) |
| ***G10D 3/06*** | (2006.01) |
| ***G10D 3/12*** | (2006.01) |

(52) U.S. Cl.

CPC ..... *G10D 3/146* (2013.01); *G10D 3/00* (2013.01); *G10D 3/04* (2013.01); *G10D 3/06* (2013.01); *G10D 3/14* (2013.01); *G10D 3/143* (2013.01)

(58) Field of Classification Search

CPC ..... G10D 3/00; G10D 3/14; G10D 3/143
USPC ..... 84/312 R, 453
See application file for complete search history.

(56) References Cited

U.S. PATENT DOCUMENTS

| | | | | | |
|---|---|---|---|---|---|
| 2,073,226 | A * | 3/1937 | Schrickel | G10D 3/143 | 84/313 |
| 3,686,993 | A * | 8/1972 | Fender | G10D 3/143 | 257/720 |
| 4,135,426 | A * | 1/1979 | Rickard | G10D 3/04 | 84/267 |
| 4,354,417 | A * | 10/1982 | Glaser, II | G10D 3/143 | 84/312 R |
| 4,535,670 | A * | 8/1985 | Borisoff | G10D 3/143 | 84/297 R |
| 4,610,190 | A * | 9/1986 | Maloney | G10D 3/143 | 84/312 R |
| 4,768,415 | A * | 9/1988 | Gressett, Jr. | G10D 3/146 | 84/267 |

(Continued)

*Primary Examiner* — David Warren
*Assistant Examiner* — Christina Schreiber
(74) *Attorney, Agent, or Firm* — Wayne Edward Ramage; Baker Donelson

(57) ABSTRACT

A musical instrument pitch changing apparatus for a musical instrument having at least a first and second string is disclosed. The apparatus includes a bender lever pivotally secured to the musical instrument, a rocker arm pivotally secured to the instrument for varying the tension in the first string in response to movement of the bender lever between the first and second positions. A rocker arm mount secures the rocker arm to the first selected string in a first bending configuration or to the second selected string in a second bending configuration. The rocker arm is movable between the first selected string and the second selected string of the musical instrument.

5 Claims, 14 Drawing Sheets

(56) References Cited

U.S. PATENT DOCUMENTS

| | | | | | |
|---|---|---|---|---|---|
| 4,777,858 | A * | 10/1988 | Petschulat | G10D 3/06 | 84/314 R |
| 5,140,884 | A * | 8/1992 | Bowden | G10D 3/14 | 84/297 R |
| 5,567,897 | A * | 10/1996 | McEwen | G10D 3/143 | 84/297 R |
| 5,661,252 | A * | 8/1997 | Krawczak | G10D 3/02 | 84/291 |
| 5,814,746 | A * | 9/1998 | Stafford | G10D 3/146 | 84/297 R |
| 6,384,311 | B1 * | 5/2002 | Cota | G10D 1/085 | 84/267 |
| 7,855,330 | B2 * | 12/2010 | Lyles | G10D 3/04 | 84/297 R |
| 7,935,876 | B1 * | 5/2011 | West | G10D 3/146 | 84/200 |
| 9,076,412 | B1 * | 7/2015 | Rolling | G10D 3/146 | |
| 9,704,458 | B2 * | 7/2017 | Glaser, II | G10D 3/06 | |
| 2003/0177894 | A1 * | 9/2003 | Skinn | G10H 3/185 | 84/730 |
| 2006/0213350 | A1 * | 9/2006 | Davis | G10D 3/143 | 84/313 |
| 2008/0141843 | A1 * | 6/2008 | Thompson | G10D 3/146 | 84/313 |
| 2010/0263521 | A1 * | 10/2010 | Ierymenko | G10D 3/04 | 84/726 |
| 2013/0180378 | A1 * | 7/2013 | Baker | G10D 3/146 | 84/313 |
| 2014/0196590 | A1 * | 7/2014 | Glaser, II | G10D 3/06 | 84/453 |

* cited by examiner

MUSICAL INSTRUMENT PITCH CHANGER

This application is a continuation of U.S. patent application Ser. No. 15/232,461, filed Aug. 23, 2016, filed Aug. 9, 2016, which is a continuation of U.S. patent application Ser. No. 14/109,168, filed Dec. 17, 2013, which claims benefit of and priority to U.S. Provisional Application No. 61/751,375, filed Jan. 11, 2013, and is entitled to those filing dates for priority. The specifications, figures, and complete disclosures of U.S. Provisional Application No. 61/751,375 and U.S. patent application Ser. Nos. 14/109,168 and 15/232,461 are incorporated herein in their entireties by specific reference for all purposes.

FIELD OF INVENTION

This invention relates to the field of stringed instrument pitch changers. More particularly, this invention relates to a pitch changer capable of being readily swapped from a first pitch changing configuration to a second pitch changing configuration.

BACKGROUND OF THE INVENTION

In a stringed instrument it is often desirable to change the pitch of sound produced by a vibrating string while the string is vibrating. This effect may be accomplished by sliding fingers or a steel bar down the string by stretching a string along a fret and perpendicular to the neck or by changing the tension on the string while it is vibrating. One method of changing the pitch of sound produced by a vibrating string is by placing a lever mechanism on or in a stringed instrument that is connected to the strings for facilitating the operation of changing the tension in one or more strings.

However, typical methods of changing the pitch of sound produced by a vibrating string either require great dexterity by a user or extensive modification to the guitar. Further, a lever mechanism as described above is installed on a stringed instrument, modification to the mechanism to change the desired change in pitch in a different string requires the replacement of multiple components of the mechanism and stringed instrument. Additional modifications may be required to compensate for a different type of string being adjusted. A thicker or thinner gauge string may require a different amount of adjustment to produce a desired change in the pitch of the string.

What is needed, therefore, is a pitch changer capable of being readily moved between one or more strings of the stringed instrument without requiring the replacement of multiple components of the stringed instrument. Additionally, a pitch changer is needed that is capable of being adjusted to compensate for different strings on which the pitch is desired to be adjusted.

SUMMARY OF INVENTION

The aforementioned and other needs are fulfilled by one or more aspects of the invention disclosed herein. The present disclosure relates to a stringed instrument pitch changing apparatus for a changing the pitch in either a first string or a second string of the stringed instrument.

In a first aspect, the present disclosure provides a musical instrument pitch changing apparatus for a musical instrument having at least first and second musical strings. The pitch changing apparatus includes a bender lever pivotally secured to the musical instrument for moving between first and second positions, a bender saddle secured to the musical instrument for varying the tension in the first string in response to movement of the bender lever between the first and second positions, and a modified string mount for securing the bender saddle to the first selected string in a first bending configuration or to the second selected string in a second bending configuration. The bender saddle is movable between the first selected string and the second selected string of the musical instrument.

In one embodiment, the musical instrument string bending apparatus further includes a rocker arm secured to the bender saddle and a push block. The push block includes a first collector arm secured to and extending from the push block, and a second collector arm secured to and extending from the push block substantially opposite the first collector arm. The first collector arm engages the bender saddle in the first bending configuration, and the second collector arm engages the bender saddle in the second bending configuration.

In another embodiment, the first collector arm secured to the push block is vertically offset from the second collector arm secured to the push block.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein.

DETAILED DESCRIPTION OF EXEMPLARY EMBODIMENTS

Figure 1:
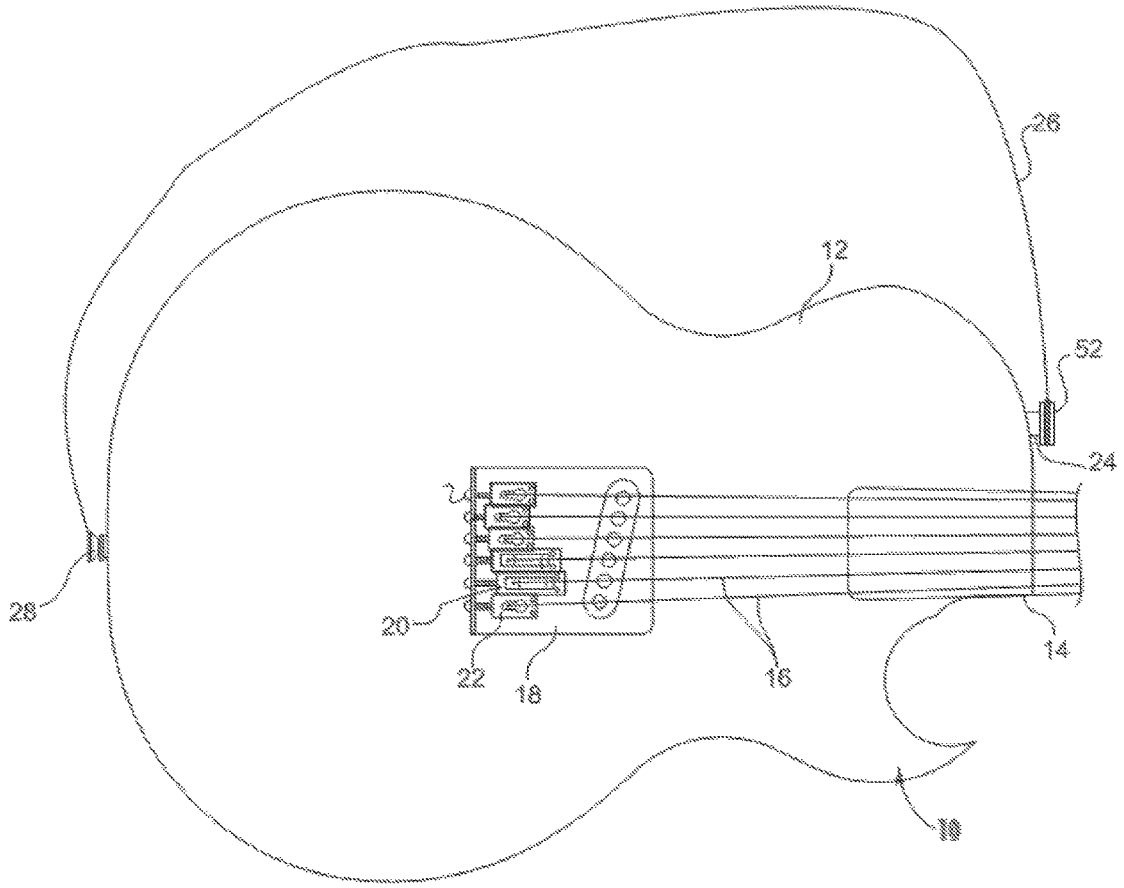
FIG. 1 is a front view of a guitar according to one embodiment of the present disclosure.

FIG. 1 depicts one embodiment of a guitar 10 including a body 12, a neck 14, one or more strings 16, and a saddle plate 18 secured to the body 12 of the guitar 10. A bender saddle 20 is pivotally mounted to the saddle plate 18 and secured to one of the one or more strings 16. The remainder of the one or more strings 16 are secured to fixed saddles 22. A bender lever 24 mounted on the guitar 10 actuates the bender saddle 20. A strap 26 is connected to the bender lever 24 and extends over a shoulder of a user of the guitar 10 before being re-connected to the guitar at a strap button 28. The user may vary the tension of the string secured to the bender saddle 20, or "bend" the string, by moving the guitar 10 in a downward direction relative to the user of the guitar. Further, the guitar 10 may be readily reconfigured such that the bender saddle 20 actuated by the bender lever 24 is attached to a second string for varying the tension in the second string.

Figure 2:
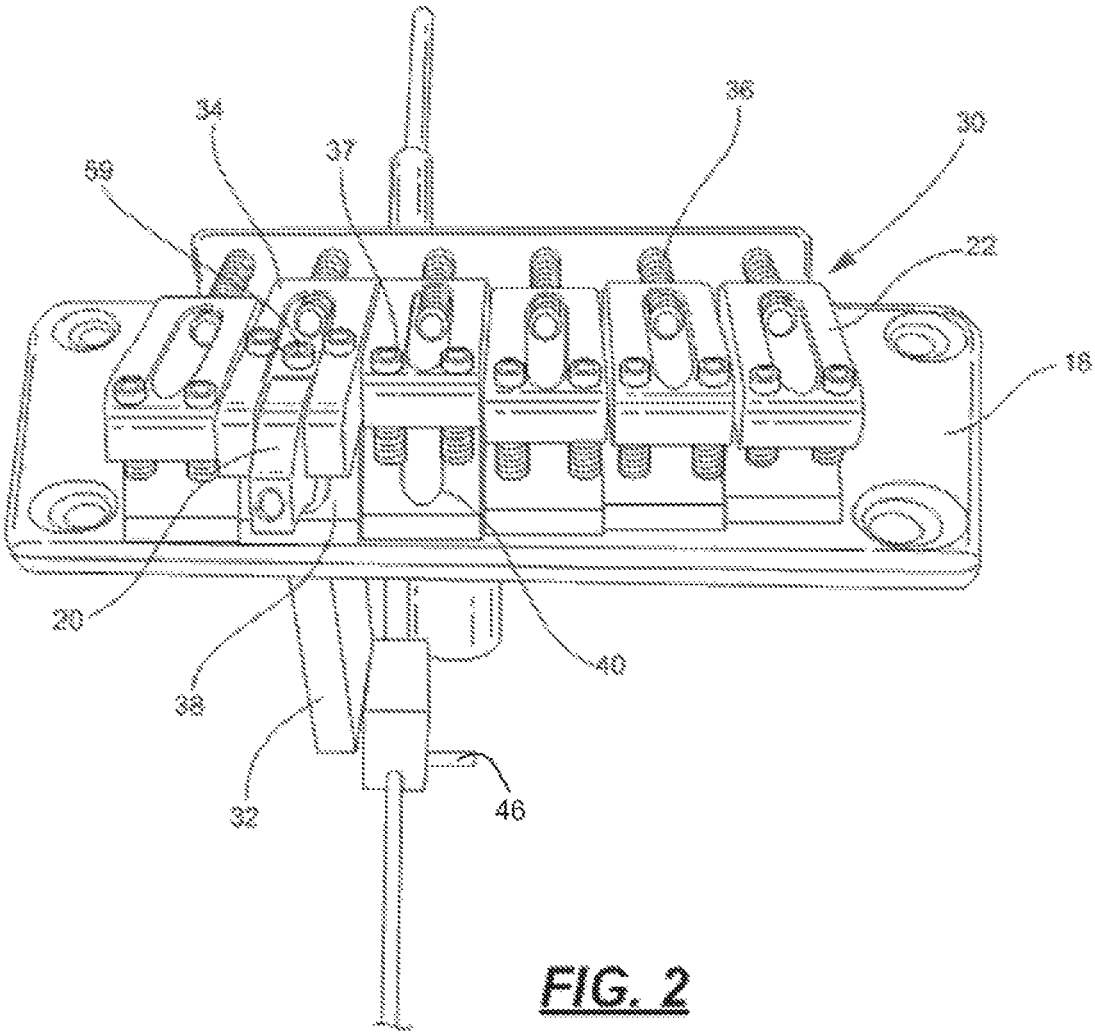
FIG. 2 is a perspective view of a pitch changing apparatus according to one embodiment of the present disclosure.

FIG. 2 illustrates one embodiment of a pitch changer 30 including the bender saddle 20 and a rocker arm 32. The one or more fixed saddles 22 and the bender saddle 20 are secured to the saddle plate 18. The bender saddle 20 is hinged on a modified string mount 34 that supports the bender saddle 20 and string 16 secured thereto while allowing the bender saddle 20 to pivot about the hinged connection to the modified string mount 34. Each of the fixed saddles 22 and the modified string mount 34 are secured to the saddle plate 18 by adjustment screws 36 so that the position of the fixed saddles 22 and modified string mount 34 may be adjusted to adjust the length of the strings 16, a process called intonation. In some embodiments, the position of the fixed saddles 22 may also be adjusted using one or more height adjustment screws 37.

The rocker arm 32 is secured to the bender saddle 20 and extends into the body 12 of the guitar 10 through a first slot 38 formed in the saddle plate 18. A second slot 40 is also formed in the saddle plate 18 for receiving the rocker arm 32 in a second configuration as described in more detail below.

Figure 3:
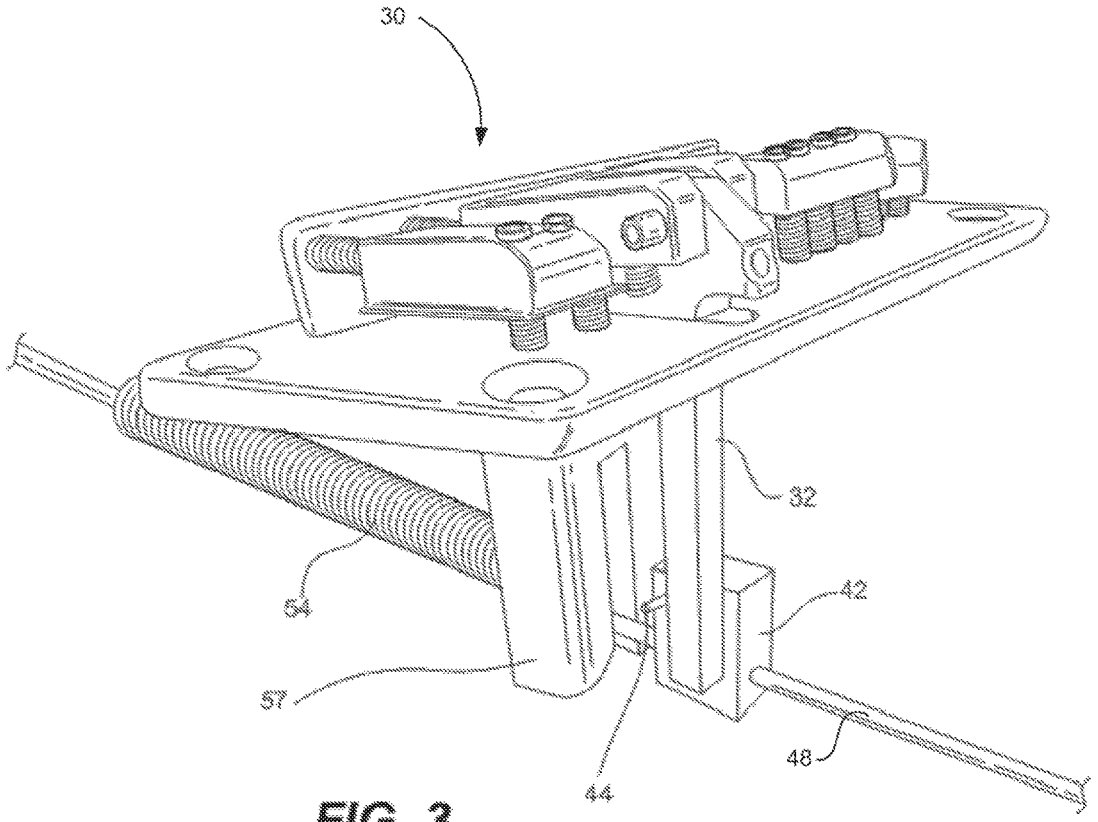
FIG. 3 is a perspective view of a pitch changing apparatus according to one embodiment of the present disclosure.

Referring to FIG. 3, the rocker arm 32 extends through the saddle plate 18 and is positioned adjacent a push block 42 within the body 12 of the guitar 10. The push block 42 includes a first collector arm 44 and a second collector arm 46 (FIG. 4) extending substantially opposite the first collector arm 44 for contacting the rocker arm 32 in the second configuration. The first collector arm 44 is horizontally off-set from the second collector arm 46 as illustrated in FIG. 5. Alternatively, the first collector arm 44 and second collector arm 46 may be vertically offset from one another. By offsetting collectors 44 and 46, the pitch changer may compensate for the throw length of different strings for bending. For example, a B-string and G-string of the guitar may require different amounts of variation in their tension to produce a desired pitch change. When the pitch changer is in a first configuration such that the bender saddle 20 and rocker arm 32 are secured to the B-string, the rocker arm 32 engages the first collector arm 44 to bend the B-string to produce a desired pitch change in response to movement of the bender lever 24. When the pitch changer is in a second configuration such that the bender saddle 20 and rocker arm 32 extend through the second slot 40 of the saddle plate 18 for bending the G-string, the rocker arm 32 engages the second collector arm 46 that is substantially offset from the first collector arm 44 such that the same movement of the bender lever 22 produces the same desired pitch change in the G-string.

Figure 4:
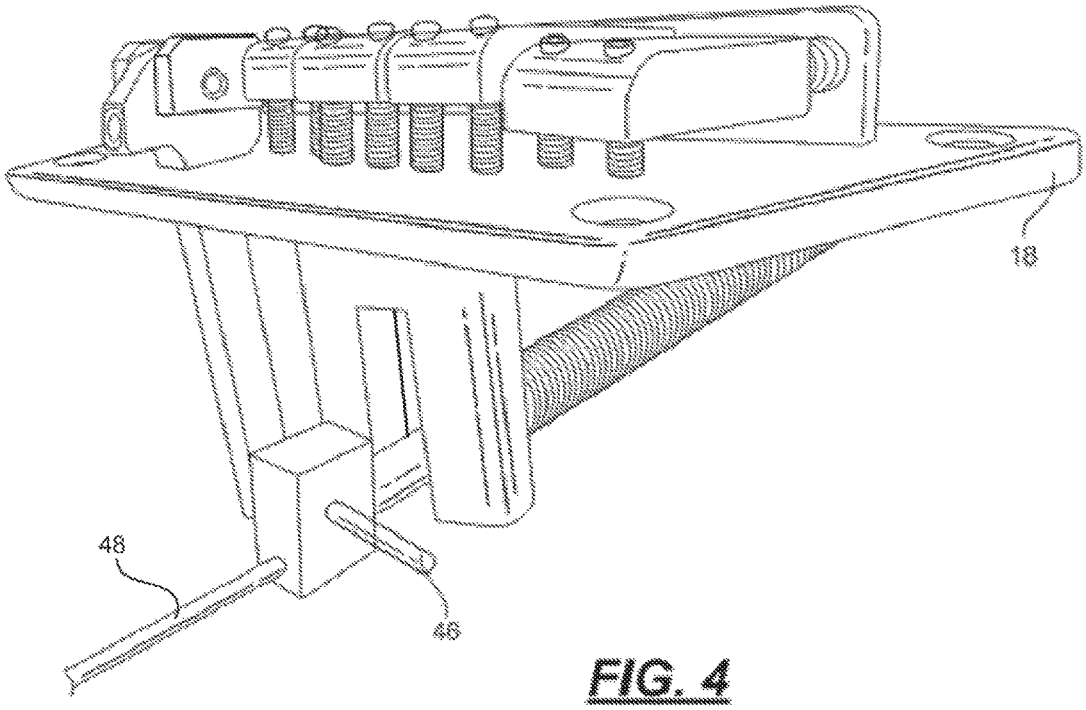
FIG. 4 is a perspective view of a pitch changing apparatus according to one embodiment of the present disclosure.
Figure 5:
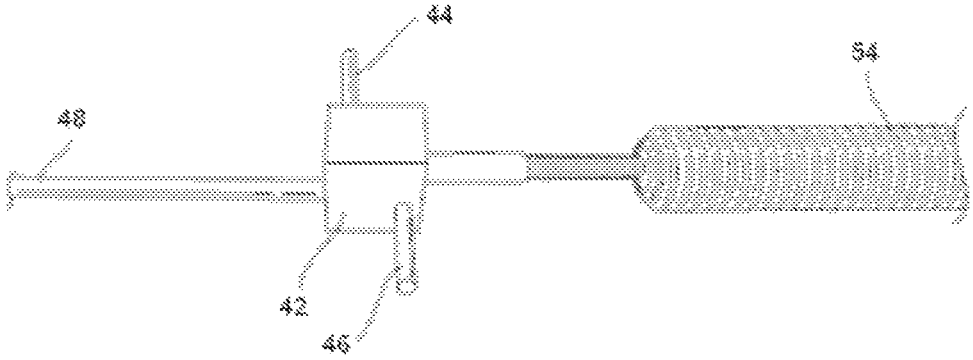
FIG. 5 is a perspective view of a push block according to one embodiment of the present disclosure.
Figure 6:
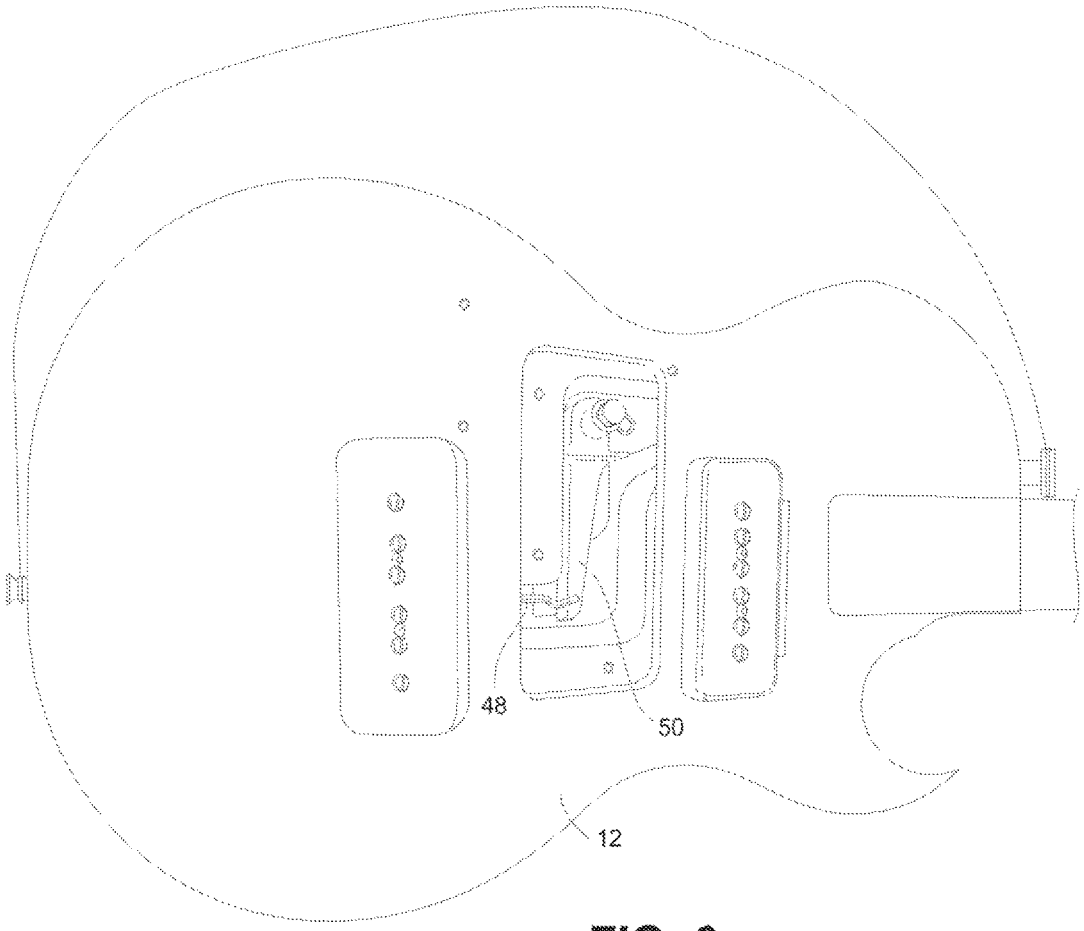
FIG. 6 is plan view of a guitar and mechanical drive according to one embodiment of the present disclosure.
Figure 7:
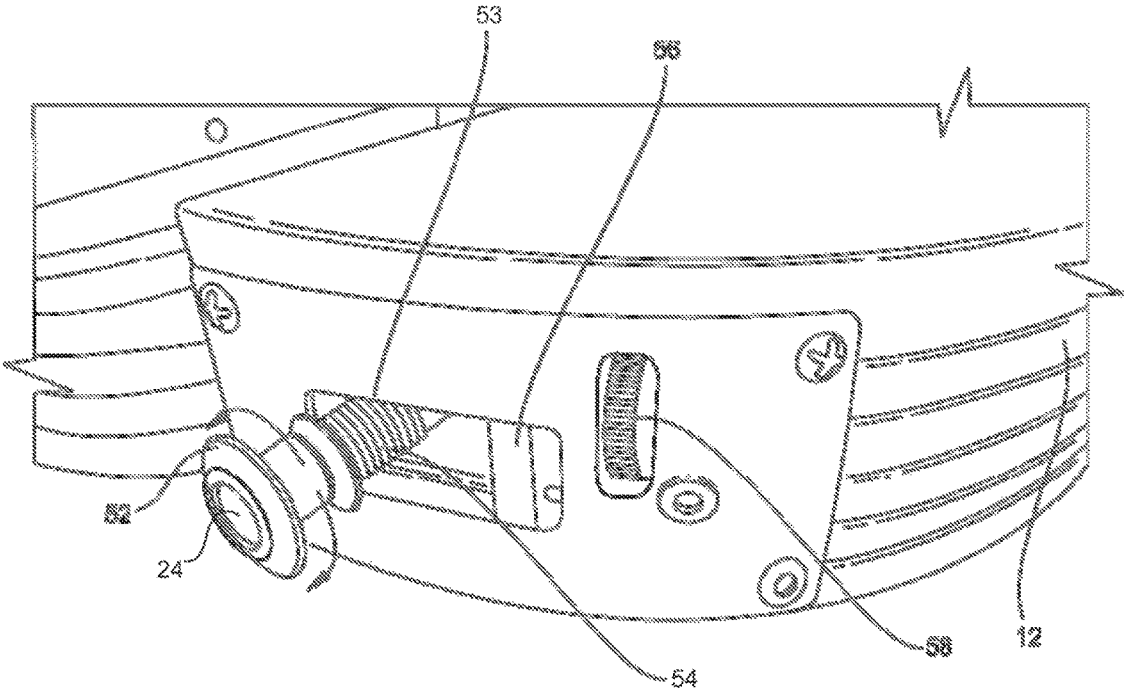
FIG. 7 is a perspective view of a strap button and adjustment knob according to one embodiment of the present disclosure.

A mechanical drive provides a mechanical connection between the bender lever 24 and rocker arm 32 and is comprised of a rod 48, a lever arm 50 (FIG. 6), and the push block 42 (FIGS. 4 and 5). The rod 48 is connected to the push block 42 and extends from the push block 42 in a direction that is perpendicular to the first collector arm 44 and second collector arm 46. The rod 48 extends through the body 12 of the guitar 10 and is secured to the lever arm 50 located within the body 12 of the guitar 10 as shown in FIG. 6. The pitch changer 30 further includes a spring 54 (FIG. 3) connected to the rod 48 for providing resistance to the bender lever 24 as it moves from a first position to a second position. The lever arm 50 is pivotally secured to the guitar 10 and is further secured to the bender lever 24 extending from the body 12 of the guitar 10. As shown in FIG. 7, the bender lever may include a strap button 52 configured for receiving an end of the guitar strap 26.

A bender lever stop 56 is positioned adjacent the bender lever 24 to limit the travel of the bender lever 24. The bender lever stop 56 is connected to an adjustment knob 58 that allows the lateral position of the bender lever stop 56 to be adjusted, thereby limiting the distance that the bender lever 24 is allowed to travel in opening 53. The bender lever 24 is held in the first position, illustrated in FIG. 7, by the spring 54. The bender lever reaches the second position when it contacts the bender lever stop 56 as the user moves the guitar in a downward direction.

When the user desires to reconfigure the pitch changer 30 such that the tension of a second string is varied, the saddle plate 18 and bender saddle 20 are readily configured for mounting the bender saddle 20 and rocker arm 32 in a second position. For example, if the pitch changer 30 is in a first configuration for bending the B-string of the guitar 10 and the user desires to configure the pitch changer for bending a G-string of the guitar, a first step requires removing the B-string and G-string of the guitar. After removing the B and G-strings, the bender saddle 20 and rocker arm 32 secured thereto are removed from the guitar. The fixed saddle 22 in the G-string position is then removed from the guitar and installed in the B-string position where the bender saddle 20 was previously located. The bender saddle 20 is installed in the G-string position with the rocker arm 32 extending through the second slot 40 of the saddle plate 18 such that the rocker arm 32 is engaged by the offset second collector arm 46 of the push block 42.

In one embodiment, the pitch changer 30 includes an arch block 57 (FIG. 3) placed within the body 12 of the guitar 10 for anchoring the bender saddle 20 to the saddle plate 18. Because the bender saddle 20 is allowed to pivot with respect to the guitar 10, and because a string may be secured to the bender saddle 20 through the front of the bender saddle 20 as described below, the bender saddle 20 is anchored to the saddle plate 18 using the arch block 57. The bender saddle 20 may include a fastener 59 (FIG. 2) for securing the bender saddle 20 to the arch block 57. The fastener 59 may be secured to the arch block 57 using a keyed sliding block 61 (FIG. 14) such that the bender saddle 20 is allowed to slide forward or backwards using the adjustment screw 36 and then the saddle 20, bridge plate 18 and sliding block 61 are locked to the arch block 57. The arch block 57 is further configured to substantially block the second slot 40 when the pitch changer 30 is in the first configuration wherein the bender saddle 20 is installed in the first slot 38. When the pitch changer 30 is reconfigured into the second configuration, the arch block 57 may be rotated substantially 180 such that the arch block 59 blocks the first slot 38 and provides an anchor for the bender saddle 20 when the bender saddle is positioned in the second slot 40.

Figure 8:
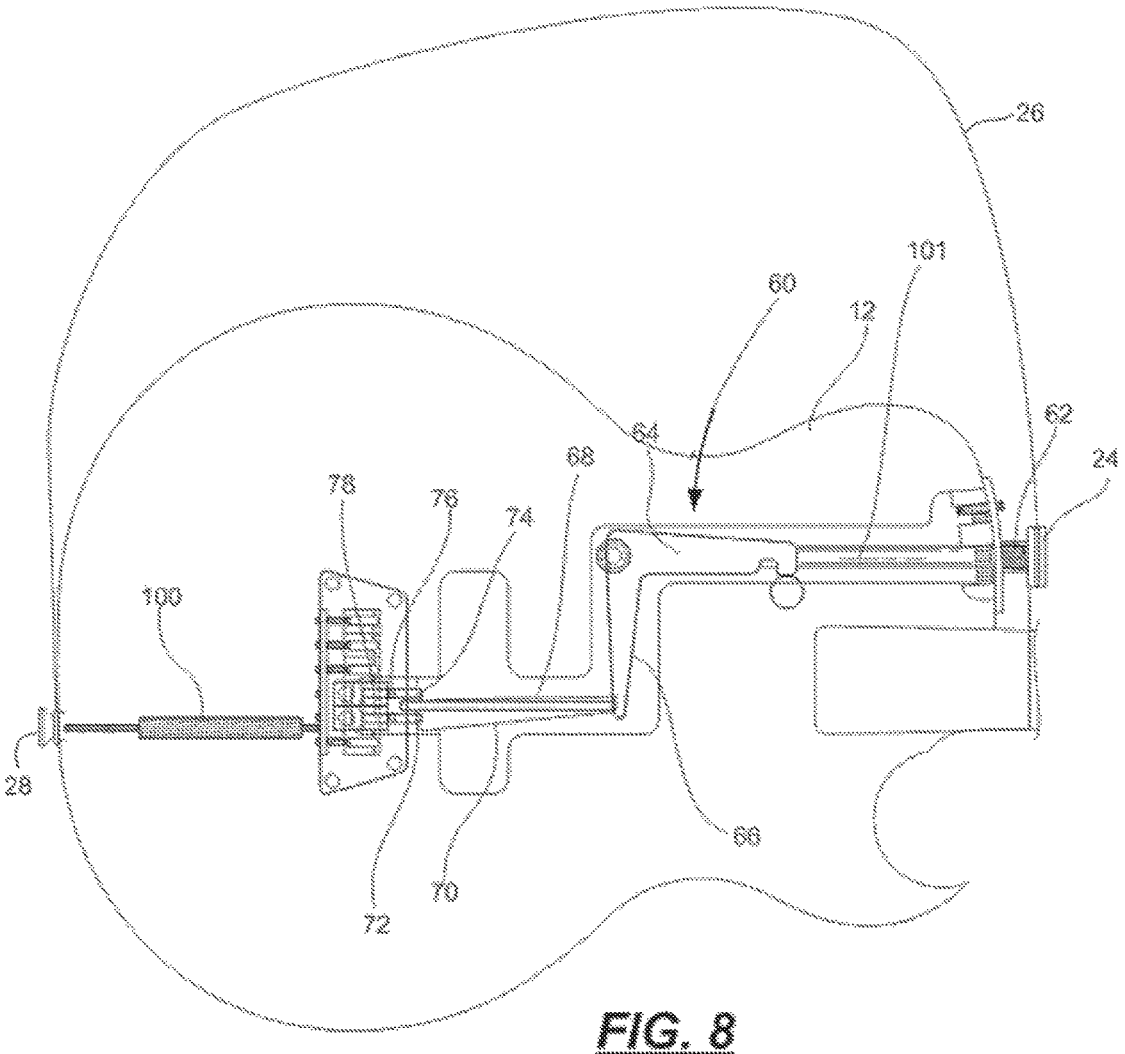
FIG. 8 is an illustration of a pitch changing apparatus according to a second embodiment of the present disclosure.

A second embodiment of a pitch changer 60 is illustrated in FIG. 8. In this embodiment, the pitch changer is "hot swappable," wherein the pitch changer is capable of being configured in either a first configuration for bending a first string or a second configuration for bending a second string without requiring disassembly or removal of any of the pitch changer components or removal of the guitar strings 16 such that the pitch changer may be reconfigured while the guitar 10 is being played by the user.

The pitch changer of FIG. 8 includes a selector knob or switch 62 secured to the bender lever 24, a first lever arm 64, a second lever arm 66 (FIG. 9), a first bender rod 68, a second bender rod 70, a first vertical collector 72, a second vertical collector 74, a first bender saddle 76, and a second bender saddle 78. The strap 26 is connected to the bender lever 24 and extends over a shoulder of a user of the guitar 10 before being re-connected to the guitar at the strap button 28. The user may vary the tension of a first string secured to the first bender saddle 76 by moving the guitar 10 in a downward direction relative to the user of the guitar. When the user desires to change the configuration of the pitch changer 60, the selector knob 62 is pulled and rotated substantially 90. degree., thereby disengaging the first string and first bender saddle and engaging a second string secured to the second bender saddle and allowing the user to vary the tension of the second string by moving the guitar 10 in a downward direction relative to the user of the guitar.

Figure 9:
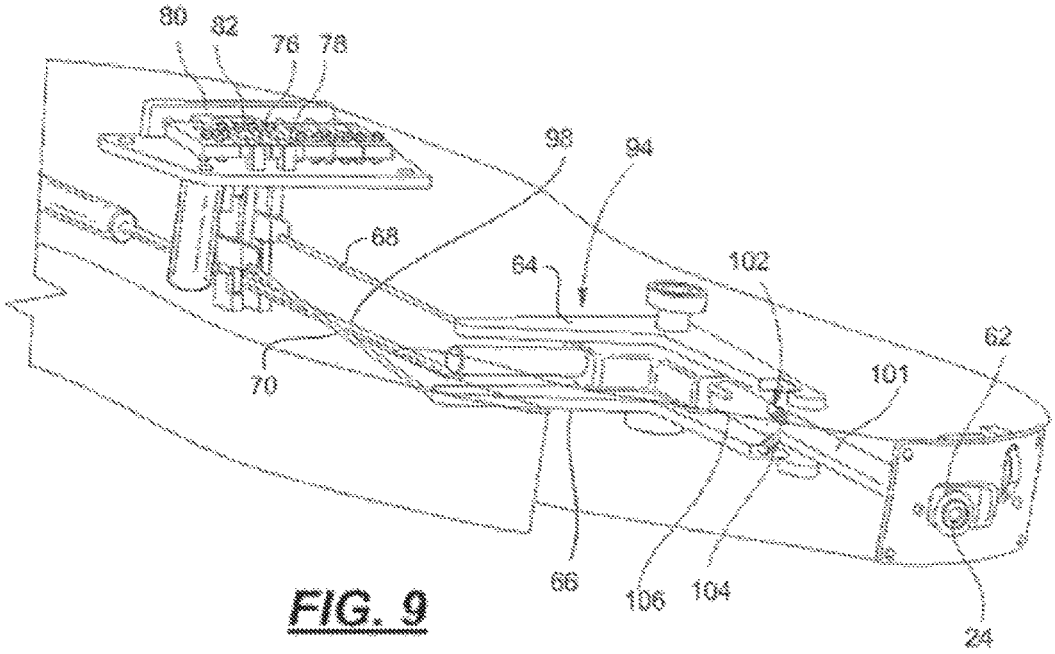
FIG. 9 is an illustration of a pitch changing apparatus according to the second embodiment of the present disclosure.

Referring now to FIG. 9, the first bender saddle 76 and adjacent second bender saddle 78 are pivotally secured to a first bender saddle mount 80 and a second bender saddle mount 82. The first bender saddle mount 80 and second bender saddle mount 82 are secured to the saddle plate 18. The first and second bender saddles 76 and 78 include a cam portion 84 and a rocker arm 86 (FIGS. 10 and 11), the rocker arm 86 extending into the body 12 of the guitar 10. The first and second bender saddles 76 and 78 also include an adjustable vertical collector 88 slidably secured to the rocker arm 86. A threaded adjustment rod 90 extends along the length of and parallel to the rocker arm 86 and threadably engages the adjustable vertical collector 88. The cam portion 84 includes an aperture 92 for accessing the adjustment rod 90 with a tool, such as a hex key or a screwdriver, for rotating the adjustment rod 90 in a clockwise or counter-clockwise direction.

Referring again to FIG. 9, a mechanical drive 94 transfers force caused by the movement of the bender lever 24 from a first position to a second position to the first bender saddle 76 or second bender saddle 78 depending on the position of the selector knob 62. The mechanical drive 94 includes the bender lever 24, the first lever arm 64, the second lever arm 66, the first bender rod 68, and the second bender rod 70. The mechanical drive 94 further includes a central lever arm 96 (FIG. 12) secured to the bender lever 24 and a central bender rod 98 secured to the central lever arm 96 and further secured to a return spring 100 (FIG. 8). The bender lever 24 includes a sleeve 101 slidably positioned around the bender lever 24, the sleeve 101 including a first pin 102 extending from the sleeve 101 and a second pin 104 extending from the sleeve 101 substantially orthogonal to the first pin 102. A bender lever spring 106 is positioned around and secured to the sleeve 101 and releasably secures the sleeve 101 to the central lever arm 96 while allowing the sleeve 101 to be pulled from the central lever arm 96 to rotate the sleeve 101 for reconfiguring the pitch changer 60 as described below.

Figure 12:
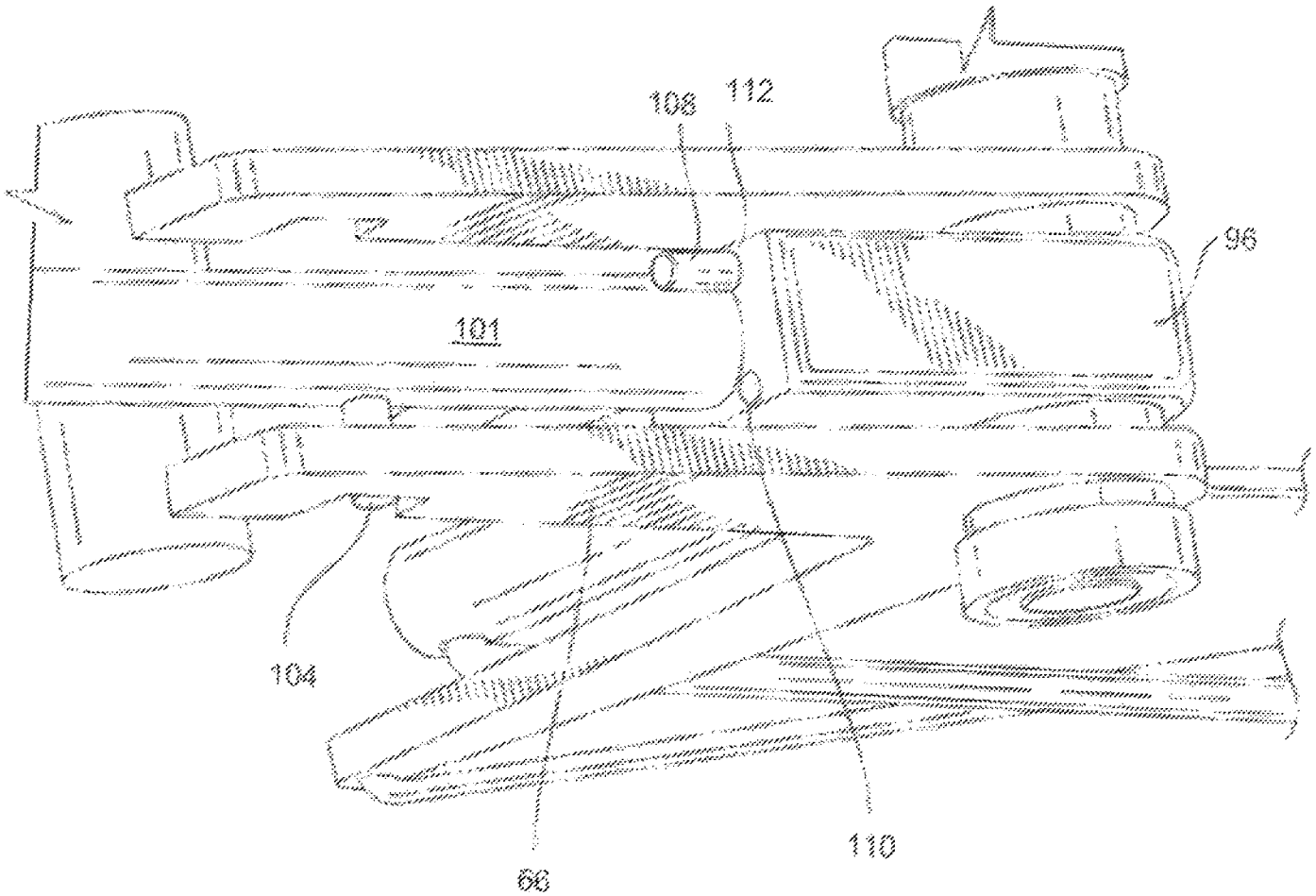
FIG. 12 is an illustration of a mechanical drive according to the second embodiment of the present disclosure.
Figure 13:
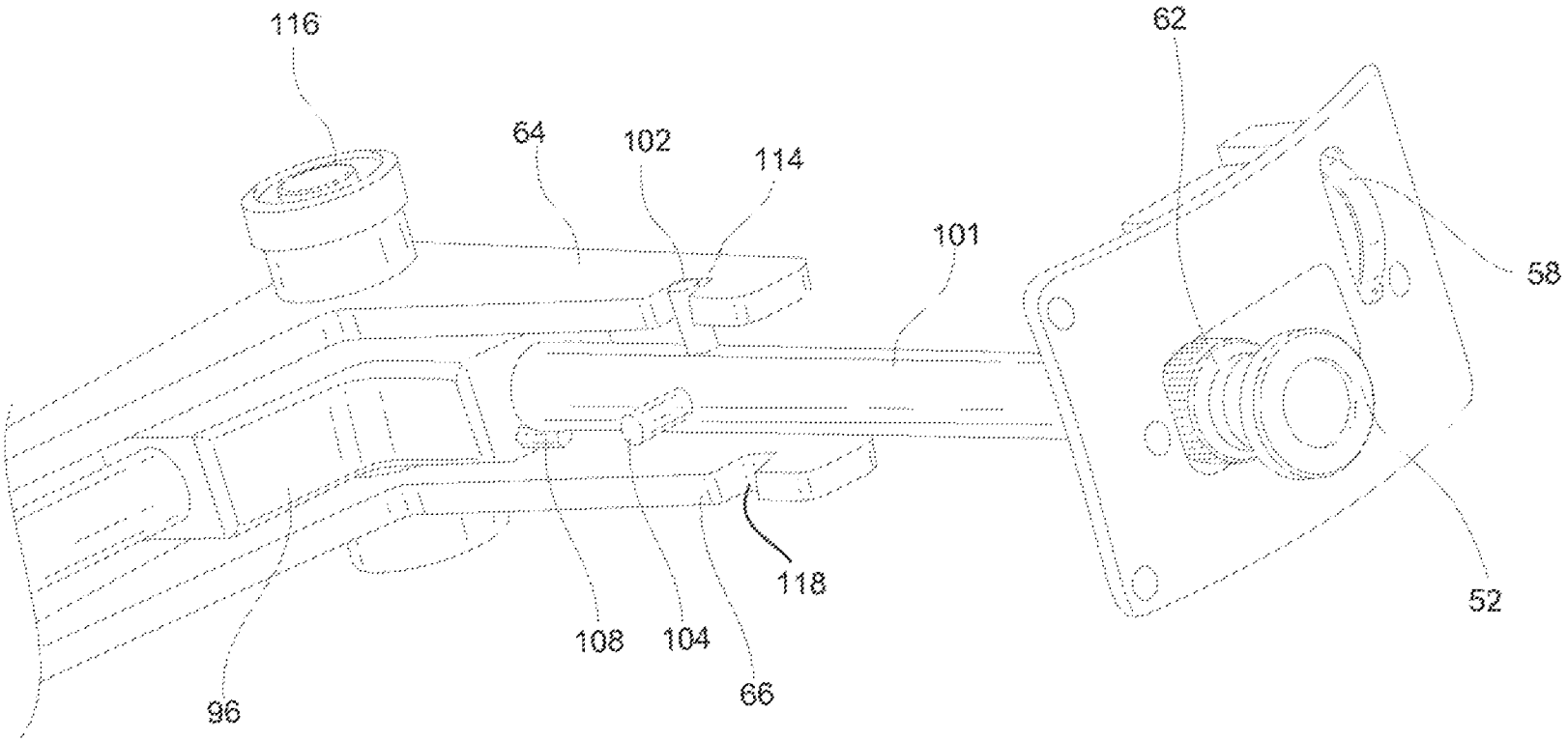
FIG. 13 is an illustration of a mechanical drive according to the second embodiment of the present disclosure.

Referring now to FIG. 12, the sleeve 101 includes a key 108 for engaging a first keyhole 110 or a second keyhole 112 on the central lever arm 96. The key 108 and first and second keyholes 110 and 112 are offset approximately 90.degree., thereby enabling the sleeve 101 to engage the central lever arm 96 in either a first configuration wherein the key 108 engages the first keyhole 110 or in a second configuration wherein the key 108 engages the second keyhole 112. In the first configuration, the first pin 102 of the sleeve 101 engages the first lever arm 64, first bender rod 68 and first bender saddle 76 secured thereto as shown in FIG. 13. When the bender sleeve 101 is in the second configuration, the second pin 104 engages the second lever arm 66, second bender rod 70 and second bender saddle 78 secured thereto.

When in use, the pitch changer 60 enables a user to readily configure the pitch changer for varying the tension in either a first desired string or a second desired string by changing the configuration of the mechanical drive 94. In the first configuration the first pin 102 of the sleeve 101 engages a first lever arm notch 114. When the user moves the guitar in a downward direction relative to the user to bend the first desired string, the first lever arm 64 rotates about a lever arm pivot 116 and pulls the first bender rod 68 secured to the first lever arm 64. When the first bender rod 68 is pulled by the first lever arm 64, the adjustable vertical collector 88 secured to the first bender rod 68 is pulled, causing the rocker arm 86 secured to the first bender saddle 76 to pivot the first bender saddle 76 and thereby vary the tension in the first desired string secured thereto. When the user desires to bend the second desired string, the selector knob 62, secured to the sleeve 101, is pulled thereby disengaging the key 108 from the first keyhole 110. The bender sleeve 101 is then rotated 90, disengaging the first pin 102 from the first lever arm 64 and engaging the second pin 104 with a second lever arm notch 118. The second lever arm 66 pulls the second bender rod 70 and second bender saddle 78 secured thereto. The adjustable vertical collector 88 pulls the rocker arm 86 secured to the second bender saddle 78, thereby varying the tension of the second desired string.

Figure 14:
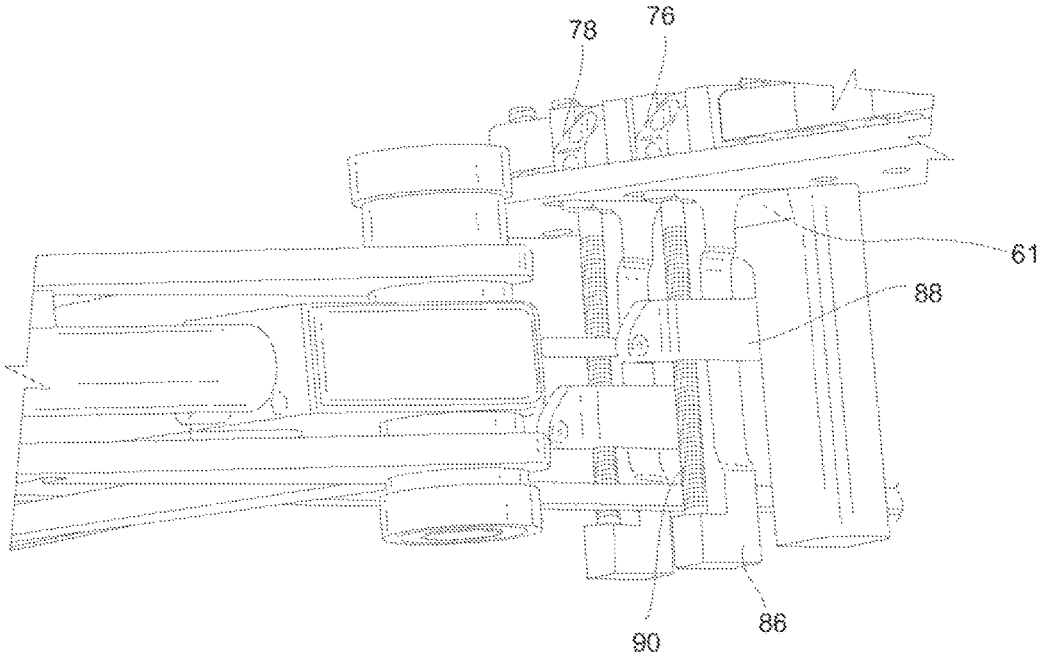
FIG. 14 is an illustration of an adjustable vertical collector according to the second embodiment of the present disclosure.

Referring to FIG. 14, the adjustable vertical collector 88 enable the pitch changer 60 to account for different changes in tension to produce a desired pitch change in both the first and second desired strings, for example, when the first desired string and second desired string are different gauges of guitar string. The position at which the adjustable vertical collector 88 engages the rocker arm 86 may be adjusted by rotating the threaded adjustment rod 90 clockwise or counterclockwise. The position of adjustable vertical collector 88 is adjusted vertically along the rocker arm 86 until a desired amount of travel of the rocker arm 86 is achieved in response to the bender lever 24 moving from the first position to the second position.

Figure 10:
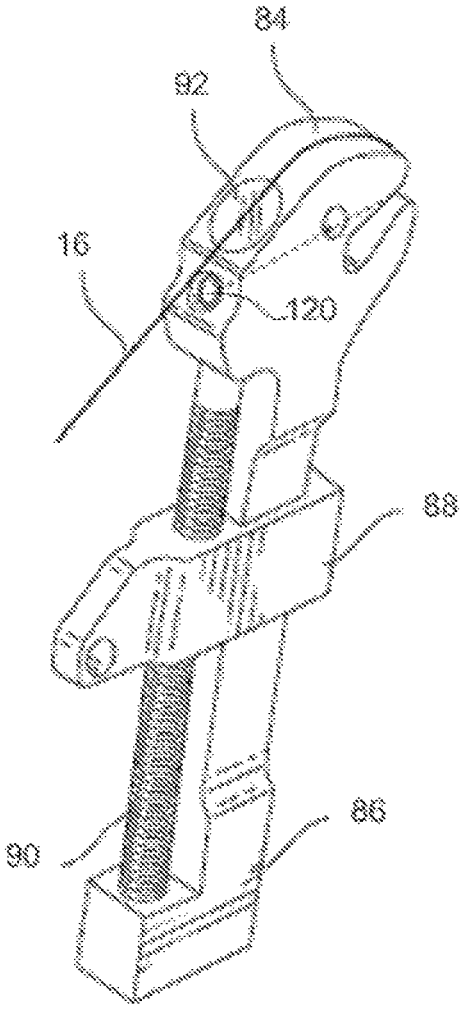
FIG. 10 is an illustration of a bender saddle according to the second embodiment of the present disclosure.
Figure 11:
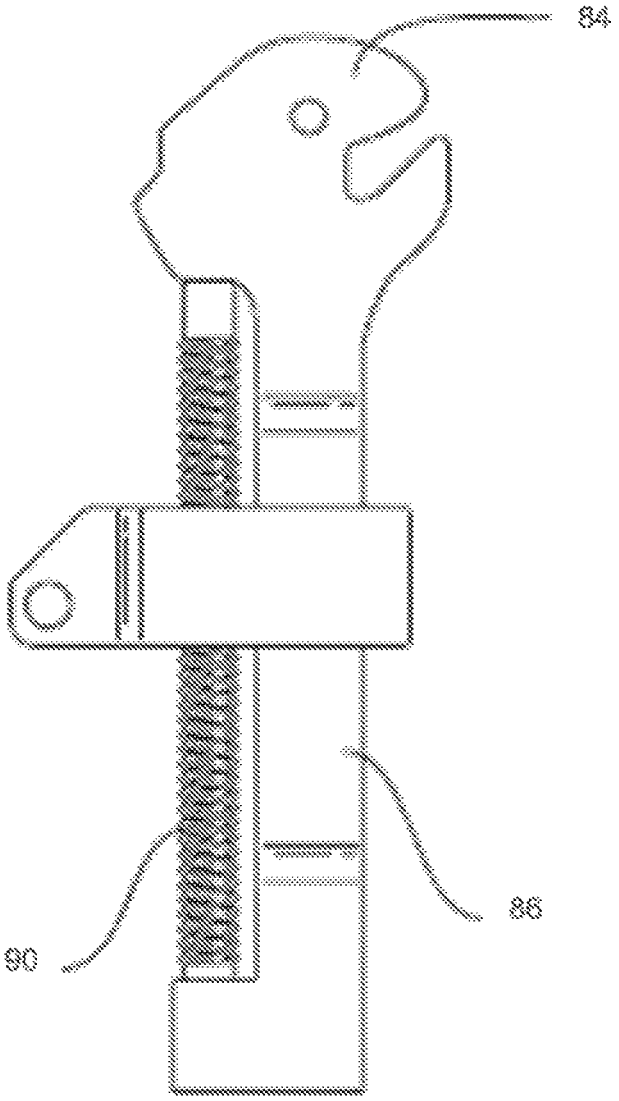
FIG. 11 is a side view of a bender saddle according to the second embodiment of the present disclosure.

In one embodiment, the first and second bender saddles 76 and 78 include a bore 120 in the front of and extending through the bender saddle for receiving a string (FIG. 10). An end of the string is threaded through the bore 120 and wrapped around the top of the bender saddle before being secured to the guitar. By securing the string to the bender saddle through the front of the bender saddle, the bender string, which may break relatively frequently due to varying the tension of the string, is easily replaceable.

In another embodiment, the bender lever may include a lockout that substantially prevents the bender lever from bending one or more strings of the guitar while a user plays the guitar.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A pitch changing apparatus, comprising:

a bender lever pivotally secured to a musical instrument configured to move between unengaged and engaged positions;

a bender saddle secured to the musical instrument configured to vary the tension in a string on the musical instrument in response to movement of the bender lever between the unengaged and engaged positions, wherein the bender saddle further comprises a head with a cam portion and a bore therethrough, said bore configured to receive a string threaded through the bore and wrapped around a portion of the cam section;

a string mount configured to secure the bender saddle to a first selected string in a first bending configuration or to a second selected string in a second bending configuration; and wherein the bender saddle is configured to move between the first selected string and the second selected string of the musical instrument.

2. The apparatus of claim 1, further comprising a rocker arm secured to the bender saddle, the rocker arm configured to move in response to movement of the bender lever.

3. The apparatus of claim 1, further comprising:

a rocker arm secured to the bender saddle; and a push block comprising a first collector arm and a second collector arm;

wherein the first collector arm is configured to engage the rocker arm in the first bending configuration, and wherein the second collector arm is configured to engage the rocker arm in the second bending configuration.

4. The apparatus of claim 3, wherein the first collector arm is offset from the second collector arm.

5. The apparatus of claim 1, further comprising a bender lever stop adjacent the bender lever.

* * * * *